US009719720B2

(12) United States Patent
Seo et al.

(10) Patent No.: US 9,719,720 B2
(45) Date of Patent: Aug. 1, 2017

(54) REFRIGERATOR AND CONTROL METHOD FOR THE SAME

(71) Applicant: LG Electronics Inc., Seoul (KR)

(72) Inventors: Woonkyu Seo, Seoul (KR); Jihyun Lee, Seoul (KR); Inhwan Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 14/221,342

(22) Filed: Mar. 21, 2014

(65) Prior Publication Data

US 2014/0320647 A1 Oct. 30, 2014

(30) Foreign Application Priority Data

Apr. 25, 2013 (KR) ..... 10-2013-0046123

(51) Int. Cl.
*H04N 7/18* (2006.01)
*H04N 9/47* (2006.01)
*F25D 29/00* (2006.01)

(52) U.S. Cl.
CPC ..... *F25D 29/00* (2013.01); *F25D 2400/361* (2013.01); *F25D 2700/06* (2013.01)

(58) Field of Classification Search
CPC ..... H04N 7/183
USPC ..... 348/143
See application file for complete search history.

(56) References Cited

U.S. PATENT DOCUMENTS 6,204,763 B1 * 3/2001 Sone ..... A47G 29/141 221/2
7,196,625 B1 * 3/2007 Nguyen ..... F25D 29/00 340/3.1
7,448,546 B2 * 11/2008 Jung ..... G06Q 10/087 235/375

(Continued)

FOREIGN PATENT DOCUMENTS

CN 103234323 A * 8/2013 ..... F25D 29/00

OTHER PUBLICATIONS

Hsu C.L., S.Y. Yang, W.B. Wu, 3C intelligent home appliance control system—Example with refrigerator, Expert Systems with Applications 37 (2010) 4337-43490.*

(Continued)

*Primary Examiner* — Zhubing Ren
*Assistant Examiner* — Richard A Hansell, Jr.
(74) *Attorney, Agent, or Firm* — Fish & Richardson P.C.

(57) ABSTRACT

A refrigerator includes a main body, a door configured to open or close a storage compartment, and a beverage receiving chamber that defines a space for reception of a beverage container. The refrigerator includes a light emitting device and a camera arranged with the beverage receiving chamber in its field of view and configured to capture an image of an interior of the beverage receiving chamber. The refrigerator includes a beverage residual quantity sensing device located in the beverage receiving chamber and configured to measure a weight of a beverage. The refrigerator includes a display configured to display a kind and residual quantity of the beverage, and a controller configured to control operation of the camera, receive a weight sensing signal from the sensing device, determine the residual quantity of the beverage based on the weight sensing signal, and provide a user with information on the kind and residual quantity.

21 Claims, 11 Drawing Sheets

(56) References Cited

U.S. PATENT DOCUMENTS

| | | | | |
|---|---|---|---|---|
| 8,109,301 | B1 * | 2/2012 | Denise | F25C 5/005 141/198 |
| 8,322,384 | B2 * | 12/2012 | Ashrafzadeh | F25D 23/126 141/192 |
| 2003/0164754 | A1 * | 9/2003 | Roseen | F25D 25/00 340/309.16 |
| 2006/0174641 | A1 * | 8/2006 | Liu | F25D 29/00 62/246 |
| 2008/0264092 | A1 * | 10/2008 | Chase | B67D 1/0858 62/389 |
| 2009/0277199 | A1 * | 11/2009 | Manas | F25D 29/00 62/129 |
| 2010/0066556 | A1 * | 3/2010 | Chishima | G01G 17/04 340/686.1 |
| 2010/0170278 | A1 * | 7/2010 | Min | F25D 17/042 62/264 |
| 2011/0016910 | A1 * | 1/2011 | Bak | F25D 29/00 62/449 |
| 2011/0303693 | A1 * | 12/2011 | Culley | F25D 23/126 222/1 |
| 2012/0102993 | A1 * | 5/2012 | Hortin | F25D 23/126 62/189 |
| 2012/0104023 | A1 * | 5/2012 | Anselmino | F25D 23/126 141/1 |

OTHER PUBLICATIONS

Hsu C.L., S.Y. Yang, W.B. Wu (3C intelligent home appliance control system—Example with refrigerator, Expert Systems with Applications 37 (2010).*

* cited by examiner

REFRIGERATOR AND CONTROL METHOD FOR THE SAME

This application claims the benefit of Korean Patent Application No. 10-2013-0046123 filed on Apr. 25, 2013, which is hereby incorporated by reference as if fully set forth herein.

FIELD

The present disclosure relates to a refrigerator and a control method for the same.

BACKGROUND

In general, a refrigerator is an apparatus in which cold air, generated via a refrigeration cycle including a compressor, a condenser, an expansion valve, an evaporator, etc., is supplied into a storage compartment to keep food stored in the storage compartment at freezing or at a temperature slightly above freezing.

A typical refrigerator internally defines two storage compartments including a freezing compartment in which foods or beverages are kept frozen and a refrigerating compartment in which foods or beverages are kept cold, but not frozen.

There are several kinds of refrigerators including a top mounting type refrigerator in which a freezing compartment is located above a refrigerating compartment, a bottom freezer type refrigerator in which a freezing compartment is located below a refrigerating compartment, and a side by side type refrigerator in which a freezing compartment and a refrigerating compartment are divided into left and right sides.

Among the aforementioned storage compartments of the refrigerator, the refrigerating compartment may receive food to be stored at a temperature of 0-5° C. Foods for storage at such a temperature slightly above freezing comprise various kinds of foods, such as vegetables, fruits, various side dishes, water, beverages, etc.

For example, milk, which may be frequently used, is stored in the refrigerating compartment. Milk may be stored on a shelf or a door basket of the refrigerating compartment.

SUMMARY

In one aspect, a refrigerator includes a main body defining a storage compartment, a door configured to open or close at least a portion of the storage compartment, and a beverage receiving chamber that defines a space for reception of a beverage container. The refrigerator also includes a light emitting device and a camera arranged with at least a portion of the beverage receiving chamber in its field of view and configured to capture an image of an interior of the beverage receiving chamber. The refrigerator further includes a beverage residual quantity sensing device located in the beverage receiving chamber and configured to measure a weight of a beverage received in the beverage receiving chamber and a display configured to display a kind and residual quantity of the beverage received in the beverage receiving chamber. In addition, the refrigerator includes a controller configured to control operation of the camera, receive a weight sensing signal from the beverage residual quantity sensing device, determine the residual quantity of the beverage based on the weight sensing signal received from the beverage residual quantity sensing device, determine the kind of the beverage, and provide a user with information related to both the kind and residual quantity of the beverage via the display.

Implementations may include one or more of the following features. For example, the refrigerator may include a door switch configured to sense whether the door is oriented in an open position or a closed position. In this example, the controller is configured to delete stored information related to the beverage based on the door switch detecting the door in the open position, and, based on the door switch detecting the door in the closed position, maintain the light emitting device in an on state, control image capture of the beverage by the camera in the on state of the light emitting device, receive a weight sensing signal of the beverage from the beverage residual quantity sensing device, and store the captured image and the weight sensing signal.

In some implementations, the beverage receiving chamber may be defined by a receiving case including a bottom part on which the beverage is placed, a sidewall part, and a cover part, and at least the sidewall part may be made of a transparent material. In these implementations, the camera may be mounted to a lateral side of a lower surface of the cover part and oriented to capture an image in a downward oblique direction.

In some examples, the receiving case may be mounted to an inner surface of the door. In these examples, the door may include a main door that has an opening and a sub door configured to open or close the opening of the main door, and the receiving case may be mounted to an inner surface of the main door and may be open toward the opening of the main door such that an interior of the receiving case is accessible through the opening when the sub door is open. Further, in these examples, the sidewall part may have an opening opposite to the main door.

In addition, the cover part may be a bottom part of another receiving shelf disposed above the beverage receiving chamber. Also, the beverage residual quantity sensing device may be mounted in a recess defined in a bottom of the beverage receiving chamber and may include a weight sensor.

In some implementations, the beverage residual quantity sensing device may include a sensor case in which the weight sensor is mounted and a support plate seated on an upper surface of the sensor case and configured to support the beverage. In these implementations, the beverage residual quantity sensing device may include a guide rib that extends upward from at least a portion of a rim of the support plate and that supports the beverage from a lateral side thereof. Further, in these implementations, a rear portion of the guide rib may have a height that is greater than that of a front portion of the guide rib from which the beverage is retrieved.

In some examples, the controller may be configured to control display of the kind and residual quantity of the beverage via the display or a mobile terminal of the user. In these examples, the controller may be configured to display the kind of the beverage using the image captured by the camera, calculate the residual quantity of the beverage based on the weight of the beverage measured by the beverage residual quantity sensing device, and display the calculated residual quantity of the beverage.

In some implementations, the controller may be configured to display a storage period of the beverage along with the kind and residual quantity of the beverage. In these implementations, the controller may be configured to alert the user via the display or the mobile terminal based on the controller detecting that the residual quantity of the beverage is a predetermined value or less or based on the controller detecting that the storage period of the beverage is a predetermined number of days or more.

In some examples, the controller may include an input device configured to receive beverage state information from the user, a microcomputer configured to process information received from the input device and the beverage residual quantity sensing device, a memory configured to store beverage state information, and a communication device configured to receive a user instruction signal and transmit the beverage state information via communication with the mobile terminal. In these examples, the controller may be configured to calculate a remaining number of days of the beverage from the storage period of the beverage based on the beverage state information including a purchase date or shelf life of the beverage input via the input device by the user, and provide the user with freshness information and a remaining number of days of the beverage.

In another aspect, a control method for a refrigerator includes sensing opening of a door using a door switch provided at a main body of the refrigerator, turning on a light emitting device based on sensing opening of the door, and sensing closing of the door using the door switch. Based on sensing closing of the door, the method includes capturing an image of an interior of a beverage receiving chamber of the refrigerator using a camera arranged with at least a portion of the beverage receiving chamber in its field of view and measuring a weight of a beverage received in the beverage receiving chamber using a weight sensor located in the beverage receiving chamber. The method also includes displaying the captured image and weight of the beverage using a display located at the door or a mobile terminal of a user and turning off the light emitting device after a predetermined time has passed from sensing closing of the door.

Implementations may include one or more of the following features. For example, the method may include deleting previously stored data based on sensing opening of the door. In this example, the method may include storing the captured image and measured weight data after completing the capturing.

In some implementations, the method may include storing the measured weight data as volume data acquired by converting the residual quantity of the beverage calculated from the measured weight data. In these implementations, the method may include displaying the stored image of the beverage and information related to the residual quantity of the beverage via the display of the refrigerator or the mobile terminal of the user based on a user request for beverage state information. Further, in these implementations, the method may include alerting the user based on detecting the calculated residual quantity of the beverage is a predetermined value or less.

In another aspect, a control method for a refrigerator includes receiving, by a controller located at a main body of the refrigerator, a request for beverage state information from a user. Based on receiving the request for beverage state information, the method includes turning on a light emitting device in the refrigerator, capturing an image of an interior of a beverage receiving chamber of the refrigerator using a camera arranged with at least a portion of the beverage receiving chamber in its field of view, and measuring the weight of a beverage received in the beverage receiving chamber using a weight sensor located at a bottom of the beverage receiving chamber. The method also includes storing the captured image and measured weight data and turning off the light emitting device.

Implementations may include one or more of the following features. For example, the method may include storing the measured weight data as volume data acquired by converting a residual quantity of the beverage calculated from the measured weight of the beverage. In this example, the method may include displaying both the image and residual quantity of the beverage via a display of the refrigerator or a mobile terminal of the user.

In yet another aspect, a control method for a refrigerator includes sensing opening of a door using a door switch provided at a main body of the refrigerator. Based on sensing opening of the door, the method includes turning on a light emitting device, receiving a sensing signal from a weight sensor that is located in a beverage receiving chamber of the refrigerator and that is configured to measure a weight of a beverage, capturing an image of an interior of the beverage receiving chamber using a camera arranged with at least a portion of the beverage receiving chamber in its field of view, and storing data related to the weight of the beverage based on detecting that the sensing signal of the weight sensor differs from a previous sensing signal. The method also includes sensing closing of the door using the door switch and turning off the light emitting device after a predetermined time has passed from closing of the door.

Implementations may include one or more of the following features. For example, the method may include judging whether or not a change point in time of the sensing signal from beverage absence to beverage presence is within a predetermined time from a previous change point in time of the sensing signal from beverage presence to beverage absence. In this example, the method may include, based on judging that the change point in time of the sensing signal is within the predetermined time, capturing an image of the interior of the beverage receiving chamber using the camera and storing data related to the weight of the beverage and continuously counting storage time by adding a previous storage time counted from the change point in time of the sensing signal from beverage absence to beverage presence.

In some implementations, the method may include, based on judging that the predetermined time has passed, deleting previously stored data including the image captured by the camera and the sensing signal of the weight sensor, capturing an image of the interior of the beverage receiving chamber using the camera, receiving a sensing signal from the weight sensor to store data related thereto, and counting storage time from the change point in time of the sensing signal from beverage absence to beverage presence. In these implementations, the method may include displaying the image captured by the camera, and a residual quantity and storage period of the beverage via the display installed to a front face of the refrigerator or the mobile terminal of the user.

In some examples, the method may include displaying, on the display or the mobile terminal, a shelf life of the beverage input via an input device of a controller by the user. In these examples, the method may include alerting the user via the display or the mobile terminal based on detecting that the storage period is a predetermined number of days or more, or based on detecting that a remaining number of days of the beverage is a predetermined number of days or less.

DETAILED DESCRIPTION

Figure 1:
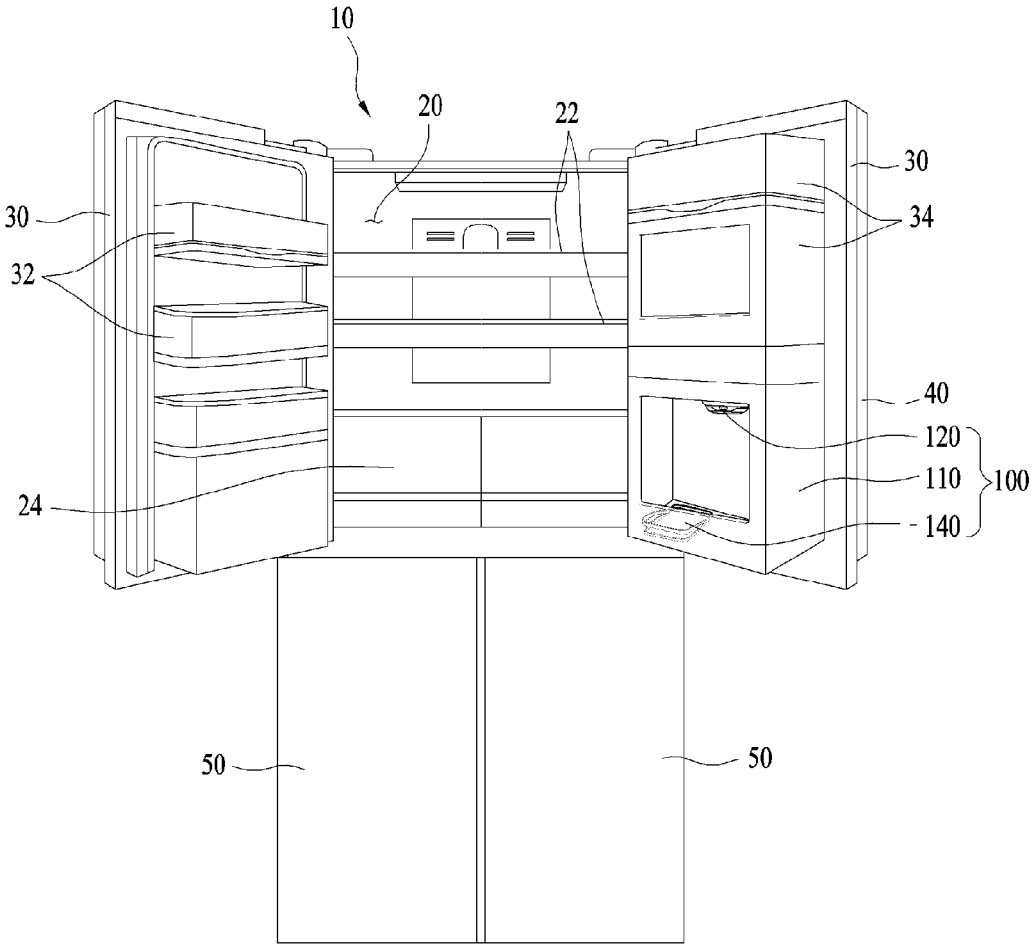
FIG. 1 is a front view of an example refrigerator.

FIG. 1 illustrates an example refrigerator.

The refrigerator is a bottom freezer type refrigerator in which a refrigerating compartment 20 and a freezing compartment are defined as upper and lower compartments within a main body 10. However, other types of refrigerators may be used, including a top mounting type refrigerator and a side-by-side type refrigerator.

Refrigerating compartment doors to open or close the refrigerating compartment 20 may comprise a pair of main doors 30 rotatably installed at both lateral edges of an upper section of the main body 10, and a pair of sub doors 40 rotatably installed to the main doors 30, respectively.

Freezing compartment doors 50 to open or close the freezing compartment may also comprise a pair of doors rotatably installed at both lateral edges of a lower section of the main body 10. However, drawer type freezing compartment doors may be used.

The refrigerating compartment 20 may be provided with a plurality of shelves 22 which may be installed in an upper region of the refrigerating compartment 20. The shelves 22 may be mounted to and supported by cantilever shaped shelf guides, or may be supported by a plurality of shelf support portions protruding from left and right sidewalls of the refrigerating compartment 20.

A drawer 24 may be mounted into or withdrawn from a lower region of the refrigerating compartment 20, and in turn a shelf may be disposed on the drawer 24 to define a food storage space in the drawer 24.

A plurality of door baskets 32 or a plurality of receiving cases 34 may be mounted to an inner surface of each of the main doors 30.

Specifically, the receiving cases 34 may be mounted to the inner surface of the right main door 30 of the refrigerating compartment 20. In a closed state of the right main door 30, the receiving cases 34 define receiving spaces which a user can access by opening the corresponding sub door 40.

As such, the receiving spaces defined by the receiving cases 34 are separate spaces isolated from the refrigerating compartment 20, and thus may be referred to as auxiliary storage compartments.

Note that the receiving cases 34 are not applied to only refrigerators having main doors and sub doors, and may be applied to all refrigerators having a beverage receiving chamber provided in a storage compartment or at an inner surface of a door.

As will be described below with reference to FIG. 6, a refrigerator may include a door switch to sense opening or closing of a door, and a light emitting device to be turned on or off based on the sensed result of opening or closing of the door.

More specifically, when the door is open, the door switch senses opening of the door and turns on the light emitting device to illuminate the interior of a storage compartment, thereby assisting the user in viewing the interior of the storage compartment. Then, when the door is closed, the door switch senses closing of the door and turns off the light emitting device to reduce unnecessary power consumption.

As shown in FIG. 1, a lowermost one of the receiving cases 34, i.e. a receiving case 110 may define a beverage receiving chamber 100.

Note that the beverage receiving chamber 100 is not limited to the receiving case 110 mounted to the inner surface of the door 30, and may be defined at another position within the refrigerating compartment 20.

In addition, note that the beverage receiving chamber 100 is not limited to the lowermost one of the receiving cases 34 mounted to the inner surface of the door 30, and may be defined in an intermediate one or an uppermost one of the receiving cases 34.

The receiving case 110 comprises a bottom part on which beverages are placed, a sidewall part, and a cover part. At least the sidewall part may be formed of a transparent material.

As shown in FIG. 1, the receiving case 110 is mounted to the inner surface of the main door 30 and has a front opening and a rear opening. Thus, the user may access beverages received in the receiving case 110 through the front opening when opening the sub door 40, or may access the beverages through the rear opening when opening the main door 30.

Naturally, when opening the main door 30, the user may view beverages received in the receiving case 110 not only through the rear opening, but also through the sidewall part because at least the sidewall part of the receiving case 110 is transparent.

Figure 2:
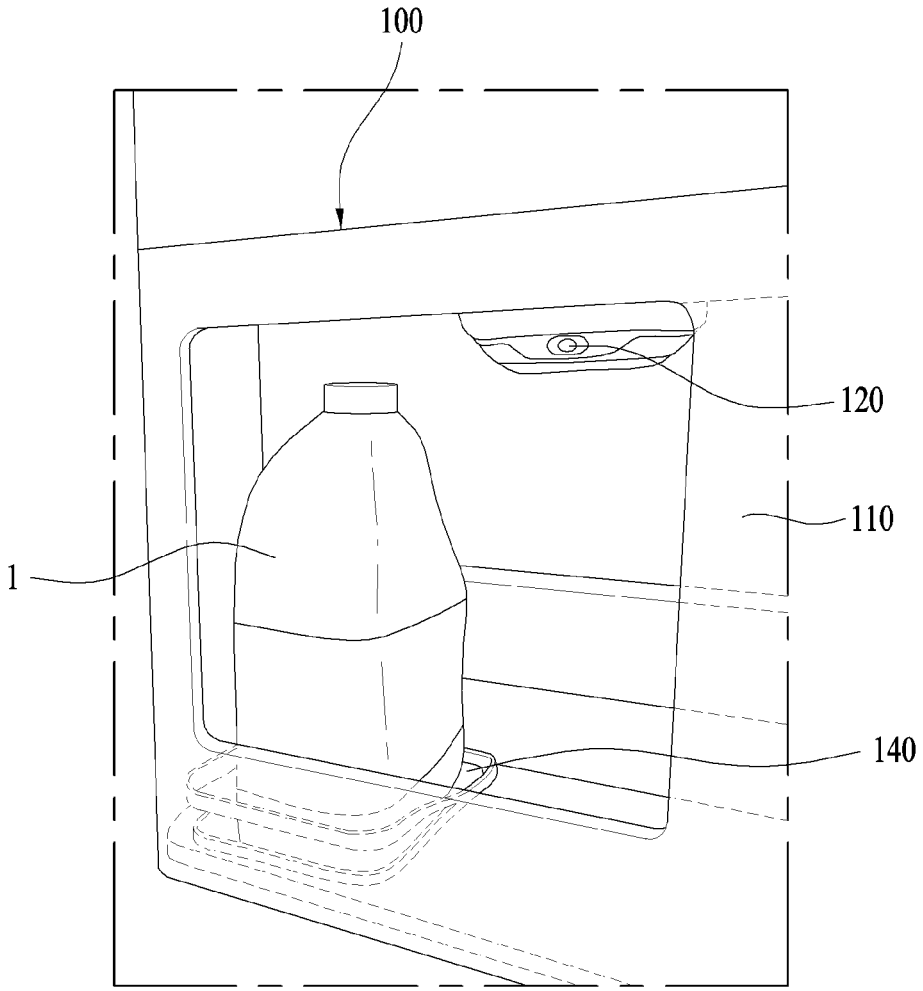
FIG. 2 is an enlarged perspective view of an example beverage receiving chamber.

As shown in the enlarged view of FIG. 2, a camera 120 to selectively capture an image of the interior of the beverage receiving chamber 100 and a beverage residual quantity sensing device 140 to measure the weight of a beverage are installed in the beverage receiving chamber 100.

The camera 120 is installed to the ceiling of the receiving case 110 defining the beverage receiving chamber 100 to capture an image downward.

The beverage residual quantity sensing device 140 is installed at the bottom of the receiving case 110 at a lateral position.

The beverage receiving chamber 100 may receive various kinds of beverages, such as mineral water, juice, carbonated drinks, alcoholic beverages, etc. as well as milk.

Although several kinds of beverages may be received in the beverage receiving chamber 100, a representative example may be milk, which exhibits a high retrieval and drinking frequency, must be kept refrigerated, and is easily spoiled.

Milk products are typically carefully managed because they have a short shelf life, are kept refrigerated after production, and are often consumed on a daily basis.

In some implementations, the receiving case 110 has a reception width to receive several beverages at the same time, and therefore the beverage residual quantity sensing device 140 may be located in a left region or right region of the bottom of the receiving case 110.

The camera 120 may serve to capture an image of all beverages received in the beverage receiving chamber 100, rather than capturing an image of any one beverage placed on the beverage residual quantity sensing device 140.

As such, the camera 120 may be obliquely installed to an upper rear corner of the receiving case 110 such that a lens of the camera 120 faces the center of the bottom of the receiving case 110.

FIG. 2 illustrates a milk jug 1 having a capacity of 2.3 L placed on the beverage residual quantity sensing device 140.

Figure 3:
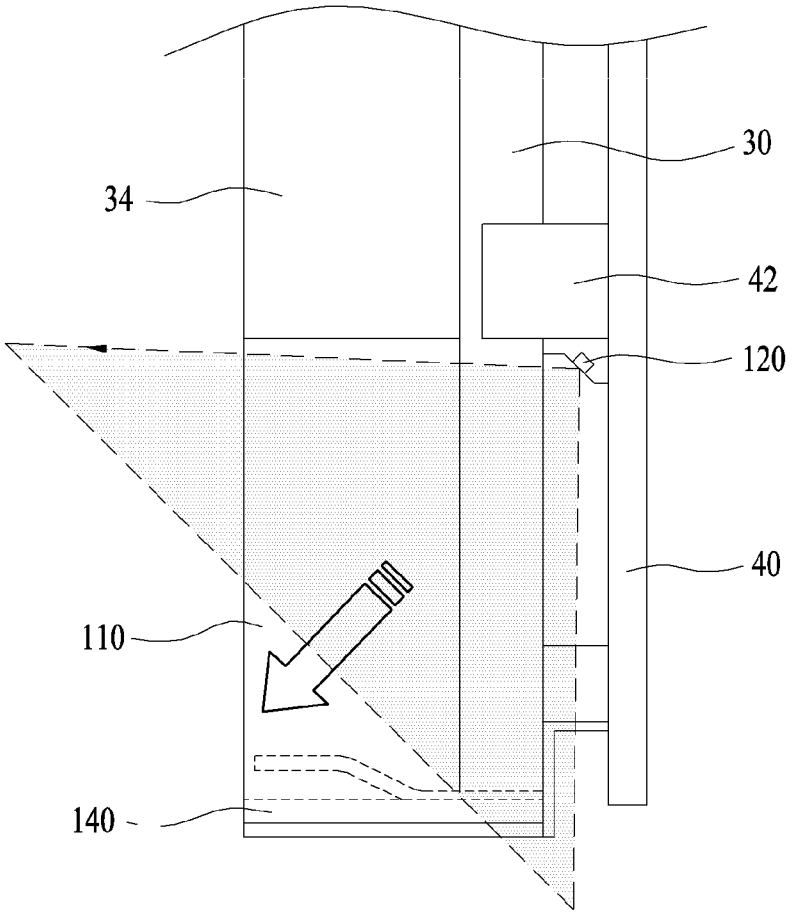
FIG. 3 is a side sectional view showing an example image capture angular range of an example camera.

FIG. 3 shows an example image capture angular range of the camera 120.

The intermediate receiving case 34 and the lowermost receiving case 110 defining the beverage receiving chamber 100 are mounted to the inner surface of the main door 30, and a small door rack 42 may be mounted to an inner surface of the sub door 40.

The door rack 42 is mounted such that the height of a lower end of the door rack 42 almost coincides with the height of an upper end of the receiving case 110.

As such, the camera 120 may be mounted at a corner between the door rack 42 and the auxiliary door 40.

Assuming the camera 120 has an image capture angle of approximately 90 degrees and is installed such that a lens of the camera 120 faces the left bottom as shown in FIG. 3, an image of the entire interior of the receiving case 110 may be captured.

Figure 4:
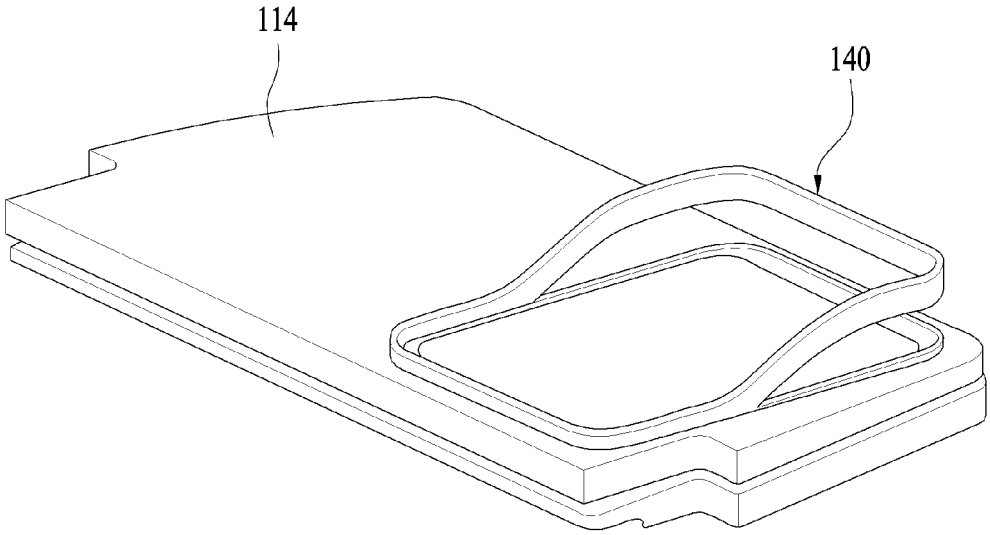
FIG. 4 is a perspective view showing an example plate defining the bottom of an example receiving case and an example beverage residual quantity sensing device installed on the plate.

FIG. 4 shows the beverage residual quantity sensing device 140 mounted on a bottom plate 114 defining the bottom of the receiving case 110.

The bottom plate 114 has a shape corresponding to that of an indentation formed in a bottom surface of the receiving case 110, and a recess for installation of the beverage residual quantity sensing device 140 is formed in a lateral region of the bottom plate 114.

Figure 5:
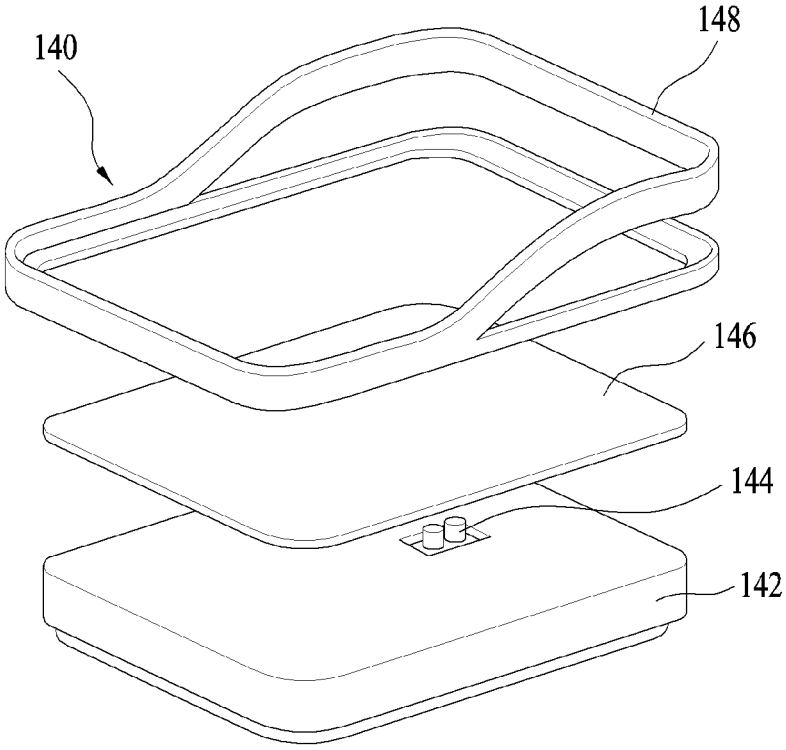
FIG. 5 is an exploded perspective view of the beverage residual quantity sensing device shown in FIG. 4.

FIG. 5 is an exploded perspective view of the beverage residual quantity sensing device 140.

The beverage residual quantity sensing device 140 comprises a sensor case 142 mounted in the recess formed in the lateral region of the bottom plate 114, a weight sensor 144 mounted in the sensor case 142, and a support plate 146 seated on an upper surface of the sensor case 142 to support a beverage container placed thereon.

The sensor case 142 may include a lower case and an upper case, and the upper case may have a center hole through which the weight sensor 144 protrudes.

The weight sensor 144 may be a sensor using a load cell, resistance of which varies based on the weight of an object.

FIG. 5 illustrates two load cells protruding through the hole perforated in the top of the sensor case 142. The weight sensor 144 may be connected to a circuit board that is mounted in the sensor case 142 at a position below the weight sensor 144.

The support plate 146 is located above the sensor case 142 to support the beverage container and to uniformly transfer load of the beverage container to the entire weight sensor 144 located below the support plate 146.

In addition, the beverage residual quantity sensing device 140 may further comprise a guide rib 148 extending upward from at least a portion of the rim of the support plate 146 to support the beverage container from the lateral side thereof.

The receiving case 110 may receive several beverages. In particular, when the receiving case 110 is mounted to the inner surface of the door 30, there is the likelihood of the received beverages laterally sliding or falling down via rotation of the door 30.

The guide rib 148 may serve not only to prevent the beverage container placed on the beverage residual quantity sensing device 140 from being exchanged in position with another beverage container, but also to inform the user of a position of the beverage residual quantity sensing device 140 provided with the weight sensor 144.

The guide rib 148 may be integrally formed with the support plate 146, or may be fabricated as a separate member.

The sensor case 142 and the support plate 146 may be formed of a plastic material. The guide rib 148 may be prefabricated as a separate metal component and later be coupled.

The guide rib 148 may be configured such that a rear portion thereof has a greater height than that of a front portion thereof from which the beverage container is withdrawn.

Here, the term front refers to a direction facing the user who accesses the beverage receiving chamber 100, and the term rear refers to a direction of the beverage receiving chamber 100 opposite to the user.

As shown, when the right refrigerating compartment door consists of the main door 30 and the sub door 40, the guide rib 148 has a higher rear portion than a front portion thereof because the user can access the beverage receiving chamber 100 from the front by opening the sub door 40.

Alternatively, when the refrigerating compartment door does not comprise the sub door and the receiving case defining the beverage receiving chamber is mounted to the inner surface of the refrigerating compartment door, the user will open the refrigerating compartment door and access the beverage receiving chamber from the inner side. Therefore, in this case, the guide rib 148 may be mounted in an orientation contrary to that of FIG. 1.

Figure 6:
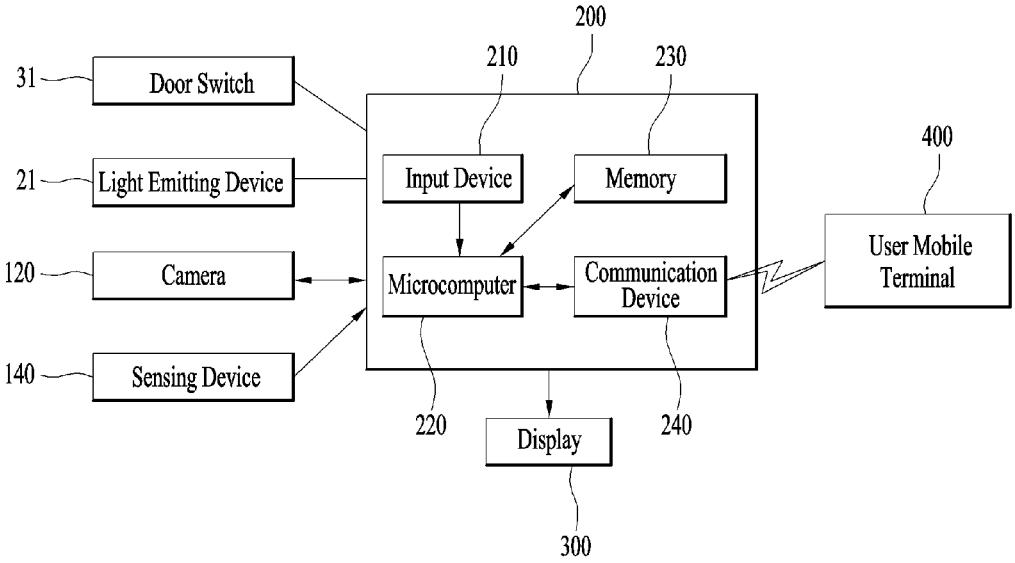
FIG. 6 is a block diagram showing example components of invention refrigerator.

FIG. 6 shows example components of a refrigerator.

The refrigerator comprises the camera 120 to capture an image of the interior of the beverage receiving chamber 100, the beverage residual quantity sensing device 140 to measure the weight of a beverage, a display 300 to display the kind and residual quantity of the beverage, and a controller 200 configured to control operation of the camera 120 and the beverage residual quantity sensing device 140 and to provide the user with information related to both the kind and residual quantity of the received beverage via the display 300.

The controller 200 may control not only operation of the camera 120 and the beverage residual quantity sensing device 140, but also running of the refrigeration cycle of the refrigerator.

The refrigerator may further comprise a door switch 31 to sense opening or closing of the door, and a light emitting device 21 installed in the storage compartment.

Although the light emitting device 21 may be operated in direct communication with the door switch 31, the light emitting device 21 may be controlled by the controller 200 that receives a sensing signal from the door switch 31. This is because an opening or closing point in time of the door and an On/Off point in time of the light emitting device 21 may be controlled differently.

The controller 200 may comprise an Input Device 210 to receive beverage state information by the user, a microcomputer 220 to calculate or judge information input from the Input Device 210 and the beverage residual quantity sensing device 140, a memory 230 to store the input, calculated, or judged beverage state information, and a Communication Device 240 to receive a user instruction signal from a mobile terminal 400 of the user and transmit the beverage state information to the mobile terminal 400 via communication with the mobile terminal 400.

The Input Device 210 is configured to allow the user to directly input beverage state information, such as, for example, the date of purchase, the date of reception, and the shelf life of a beverage.

The Input Device 210 may comprise a plurality of buttons provided at a front face of the refrigerator, or may comprise a touchscreen. When the display 300 is a touchscreen type, the beverage state information may be input via the display 300.

The microcomputer 220 serves not only to control general operation of the refrigerator, but also to calculate or judge data transmitted from the Input Device 210, the camera 120, and the beverage residual quantity sensing device 140.

The memory 230 stores the beverage state information input via the Input Device 210, or calculated or judged by the microcomputer 220.

The microcomputer 220 may sort data to be stored in the memory 230, or may extract data stored in the memory 230 to provide the user with the extracted data.

The Communication Device 240 serves to communicate with the mobile terminal 400 of the user. The Communication Device 240 may receive a user instruction signal from the mobile terminal 400, or may transmit the beverage state information to the mobile terminal 400.

The controller 200 may control display of the kind and residual quantity of a beverage on the display 300 or the mobile terminal 400 of the user.

The kind of a beverage may be perceived from an image captured by the camera 120, and the residual quantity of the beverage may be perceived from a weight value measured by the weight sensor 144 of the beverage residual quantity sensing device 140.

In this case, the controller 200 may display the kind of the beverage using the image captured by the camera 120, and may calculate the residual quantity of the beverage based on the weight of a beverage container measured by the beverage residual quantity sensing device 140 and display the calculated residual quantity of the beverage.

In some cases, the quantity of a beverage is indicated by volume rather than weight. In these cases, the residual quantity of a beverage may be indicated by a volume value converted from a measured weight value.

Given that different beverages have different densities and containers thereof also vary in weight, conversion from a measured value of the weight sensor 144 to volume may be slightly inaccurate.

However, the density of a beverage generally has little difference from the density of water. In addition, assuming that a beverage usually placed on the beverage residual quantity sensing device 140 is milk, the weight of a milk jug is not very heavy, and the density of milk may be neglected.

With regard to the kind of a beverage, although the user may perceive the kind of a beverage from the captured image, the controller 200 may judge the kind of a beverage by recognizing and analyzing the image, or the user may input the kind of a beverage via the Input Device 210 when storing the beverage.

The controller 200 may also display the storage period of a beverage along with the kind and residual quantity of the beverage.

The storage period may be input via the Input Device 210 by the user, or may be automatically calculated and judged by the controller 200 based on a sensing signal of the weight sensor 144.

A control method of automatically calculating the storage period will be described below in more detail.

When the residual quantity of a beverage is a predetermined value or less, or when the storage period of a beverage exceeds a predetermined number of days, the controller 200 may alert the user via the display 300 or the mobile terminal 400.

For example, when the beverage is milk, a small 200 ml milk box is generally consumed in one sitting. Thus, storing the milk box on the beverage residual quantity sensing device 140 is inappropriate.

Commercial larger milk jugs, such as 500 ml, 1000 ml, 1.8 L, or 2.3 L milk jugs, may be stored on the beverage residual quantity sensing device 140 for management.

Milk of 1000 ml or less is generally packed in a carton, and milk of 1.8 L or 2.3 L is generally packed in a plastic jug.

The controller 200 may alert the user when the checked residual quantity of milk is 200 ml or less, for example, thereby assisting the user in purchasing milk.

The display 300 of the refrigerator or the mobile terminal 400 of the user may display an alarm Graphic User Interface (GUI) and then display detailed alarm content on a screen when the user touches the GUI.

Alternatively, a speaker may be installed to the refrigerator to output an alarm sound message simultaneously with display of an alarm text message via the display 300.

The controller 200 may alert the user when the storage period of a beverage exceeds a predetermined number of days as well as when the residual quantity of a beverage is a predetermined value or less.

In consideration of the fact that milk should be kept refrigerated and usually has a shelf life of approximately 7 days to 10 days, but the user usually tends to purchase milk having passed approximately three days of the shelf life on average, the controller 200 may alert the user when the storage period is 5 days or more.

The storage period that is a criterion to alert the user may be set via the Input Device 210 by the user. In addition, the user may more accurately calculate the storage period for fresh storage of milk by inputting the kind of a beverage, the date of purchase of the beverage, or the shelf life of the beverage via the Input Device 210.

A control method for the refrigerator will be described below in more detail with reference to FIGS. 7 to 9.

In a control method for the refrigerator, the controller 200 may control deletion of information related to a stored beverage when the door is open, and control image capture of a container of the beverage using the camera 120 in an ON state of the light emitting device 21 and reception of a beverage weight sensing signal when the door is closed, to store the captured image and the received weight sensing signal.

Figure 7:
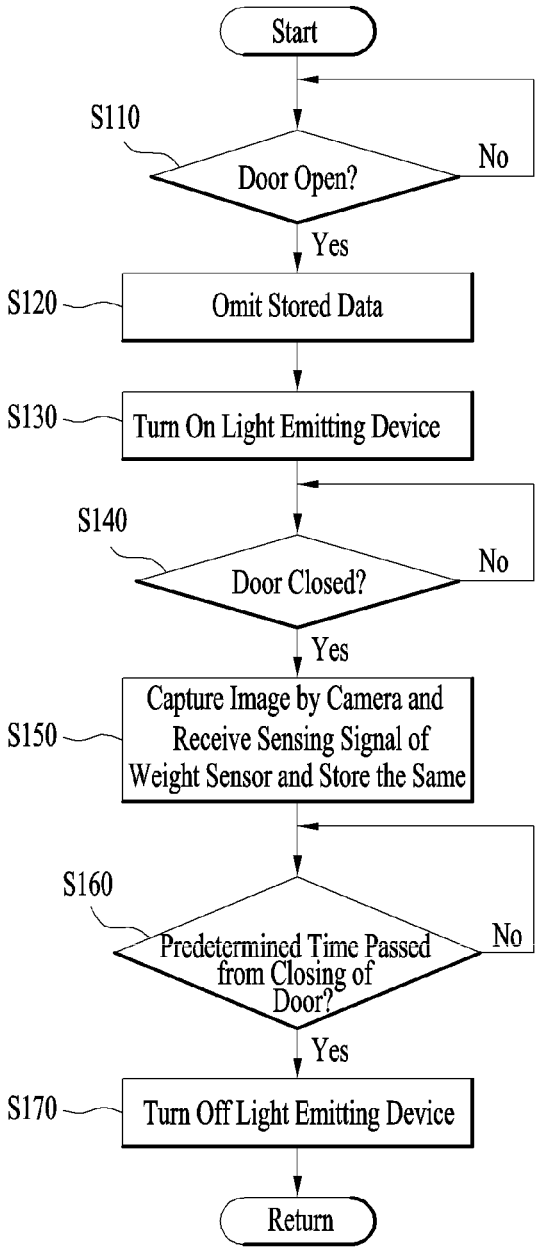
FIG. 7 is a flowchart showing an example control method.

FIG. 7 shows an example control method for the refrigerator. In the control method, image capture by the camera 120 and reception of a sensing signal of the weight sensor 144 are implemented based on opening or closing of the door.

First, when the door switch 31 senses that the door is open (S110), the controller 200 omits or deletes previous data stored in the memory 230 (S120).

Simultaneously, the controller 200 turns on the light emitting device 21 to illuminate the interior of the refrigerating compartment 20 (S130). The light emitting device 21 may be installed only in the refrigerating compartment 20, or may be additionally installed in the beverage receiving chamber 100.

When the user closes the open door and the door switch 31 senses closing of the door (S140), the controller 200 initiates capture of an image by the camera 120 and reception of sensing signal data of the weight sensor 144 and then stores the captured image and the sensing signal data in the memory 230 (S150).

In this case, even if the door is closed, the light emitting device 21 is kept on rather than being immediately turned off.

This facilitates acquisition of a clear image even if the camera 120 captures an image in a closed state of the door.

Next, the controller 200 judges whether or not a predetermined time has passed from closing of the door (S160), and turns off the light emitting device 21 when the predetermined time has passed (S170).

The predetermined time from closing of the door may be 5 seconds or less.

When the controller 200 turns off the light emitting device 21 immediately after receiving the image captured by the camera 120 and the sensing signal data of the weight sensor 144, unnecessary power consumption may be reduced.

Accordingly, the predetermined time from closing of the door may be a minimum time set in consideration of sensing time and data transmission time of the weight sensor 144, for example.

When reception of the sensing signal is sensed, the light emitting device 21 may be controlled so as to be turned off immediately after the sensing signal is received.

In addition, upon storage of the data, the measured weight data, as described above, may be converted into volume data related to the residual quantity of the beverage.

Accordingly, when the user requests beverage state information, the stored image of the beverage and the stored information related to the residual quantity of the beverage may be displayed via the display 300 of the refrigerator or the mobile terminal 400 of the user.

In particular, when the user requests display of the image and residual quantity of the beverage on the mobile terminal 400 of the user, the stored data may be transmitted to the mobile terminal 400 through the Communication Device 240 and displayed on the mobile terminal 400. In this case, since data of the beverage state information has already been stored in the memory 230, the microcomputer 220 of the controller 200 may control rapid display of the stored data on the mobile terminal 400.

In this case, the user may view a displayed alarm message when the residual quantity of the beverage is a predetermined value or less.

Next, another control method for the refrigerator will be described with reference to FIG. 8.

Instead of implementing image capture by the camera 120 and reception of the sensing signal of the weight sensor 144 based on opening or closing of the door, the controller 200 may initiate image capture by the camera 120 and reception of the sensing signal of the weight sensor 144 upon receiving a request for beverage state information from the user.

More specifically, the control method for the refrigerator comprises receiving a request for beverage state information from the user, turning on the light emitting device installed in the storage compartment of the main body, capturing an image of the interior of the beverage receiving chamber using the camera installed in the beverage receiving chamber and measuring the weight of a beverage using the weight sensor installed in the bottom of the beverage receiving chamber, and storing the captured image and the measured weight data and turning off the light emitting device.

Figure 8:
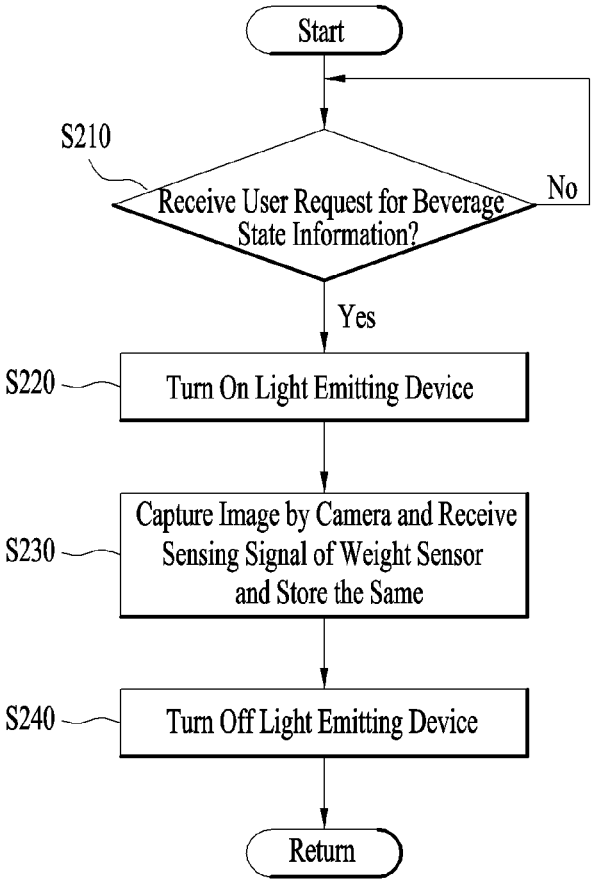
FIG. 8 is a flowchart showing another example control method.
Figure 9:
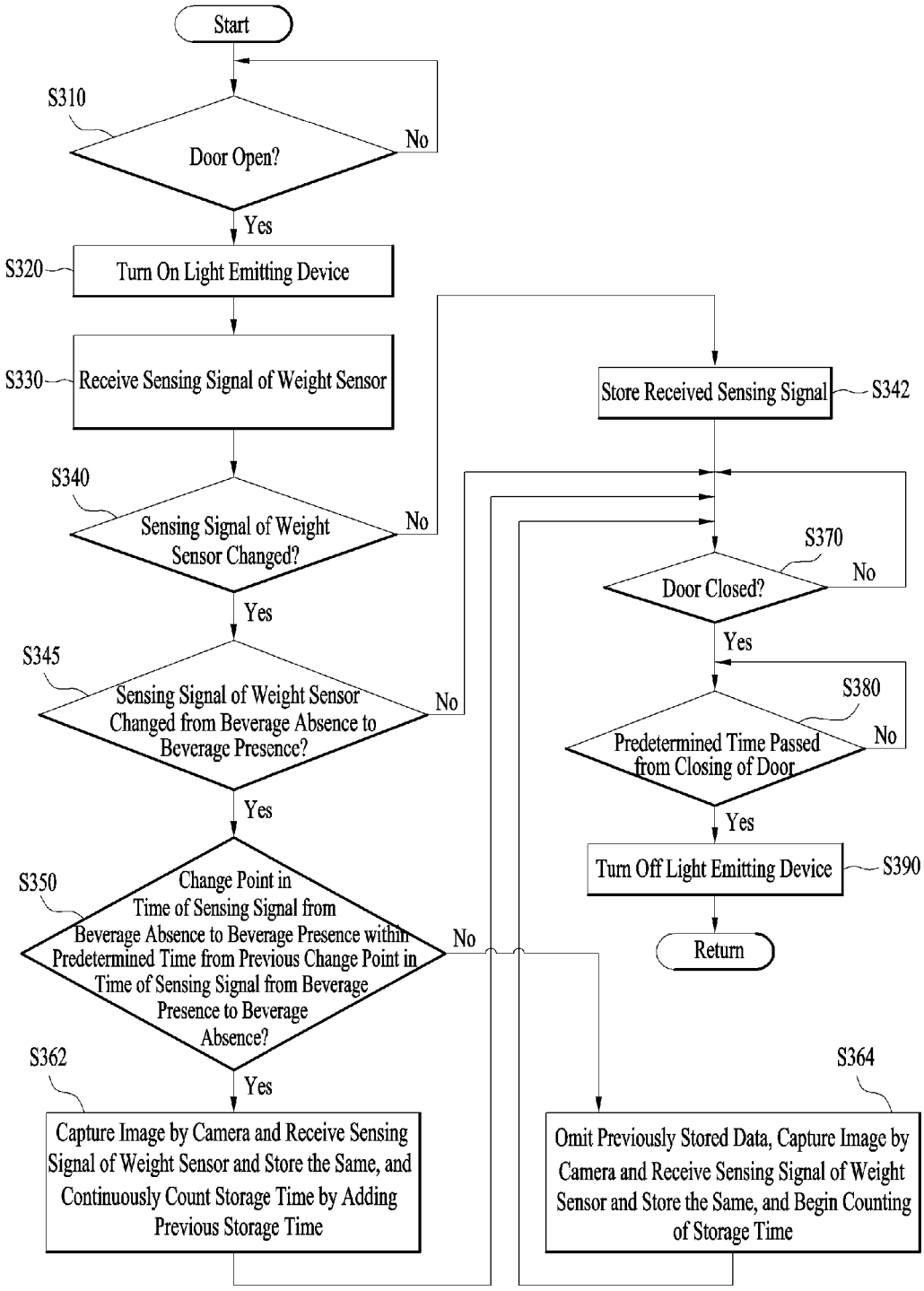
FIG. 9 is a flowchart showing yet another example control method.

As shown in FIG. 8, first, the user may request for beverage state information via the controller 200, the Input Device 210, or the touch panel type display 300 (S210).

Then, the controller 200 receives the request for beverage state information, and turns on the light emitting device 21 to illuminate the interior of the refrigerating compartment 20 or the interior of the beverage receiving chamber 100 (S220).

In a state in which the interior of the beverage receiving chamber 100 is illuminated, the controller 200 controls the camera 120 to capture an image of the interior of the beverage receiving chamber 100 and receives a sensing signal of the weight sensor 144 (S230).

Weight data of the weight sensor 144 is converted into volume data. Then, the data related to the residual quantity of a beverage as well as the captured image data are transmitted through the Communication Device 240 so as to be displayed on the display 300 of the refrigerator or the mobile terminal 400 of the user that requested display.

Although the data may be transmitted or received and displayed once, the controller 200 may store the data in the memory 230 to compare previous beverage state information with new beverage state information upon receiving a next request for beverage state information.

Thereafter, the light emitting device 21 is turned off (S240).

This method differs from the method described with respect to FIG. 7 in terms of implementing image capture by the camera in response to a user request for beverage state information in a closed state of the door so as to display current beverage state information.

In this case, as compared to the method shown in FIG. 7, sequentially implementing image capture by the camera and reception of a sensing signal of the weight sensor, data conversion, transmission of data via communication, and display of the image and residual quantity of a beverage may require longer time.

However, in terms of providing the user with current beverage state information, the method shown in FIG. 8 provides a differentiated feature from the method shown in FIG. 7 that provides past beverage state information acquired when the door is open or closed, although the past beverage state information has been recently updated. In some examples, the refrigerator may be configured to perform both the method shown in FIG. 7 and the method shown in FIG. 8.

Yet another control method for the refrigerator in will be described with reference to FIG. 9.

The control method for the refrigerator provides automatic counting of the storage time of a beverage based on opening or closing of the door.

More specifically, to count the storage time of a beverage, when a sensing signal of the weight sensor 144 is changed, it is determined whether or not to renew the storage time by calculating time passed from a previous change point in time.

First, when the door switch 31 senses that the door is open (S310), the light emitting device 21 is turned on to illuminate the interior of the refrigerating compartment 20 (S330).

Thereafter, without image capture by the camera 120, the controller 200 receives a sensing signal of the weight sensor 144 (S330).

The controller 200 judges whether or not the received sensing signal of the weight sensor 144 is changed (S340).

When the sensing signal of the weight sensor 144 is not changed, the controller 200 stores the received sensing signal (S342). In this case, although the stored data may be identical to previous data, the data is stored in the case of initial operation.

However, when judging whether or not the sensing signal of the weight sensor is initially received is possible, the controller 200 may not store the data identical to the previous data.

Then, the controller 200 judges whether or not the sensing signal of the weight sensor 144 is changed from beverage absence to beverage presence (S345).

Upon judging change of the sensing signal of the weight sensor 144 from beverage absence to beverage presence, the controller 200 judges whether or not a change point in time of the sensing signal from beverage absence to beverage presence is within a predetermined time from a previous change point in time of the sensing signal from beverage presence to beverage absence (S350).

When the change point in time of the sensing signal is within the predetermined time, this may mean that the user retrieves a beverage and pours the beverage into a cup, for example, and then again stores the beverage in the beverage receiving chamber 100.

Accordingly, image capture by the camera 120 and reception of a sensing signal of the weight sensor 144 may be implemented, or the received data may be converted and stored. Simultaneously, storage time is continuously counted by adding previous storage time counted from the change point in time of the sensing signal from beverage absence to beverage presence (S362).

On the other hand, when the predetermined time has passed, previously stored data is deleted, and image capture by the camera 120 and reception of a sensing signal of the weight sensor 144 may be implemented, or the received data may be converted and stored. Simultaneously, storage time from a change point in time of the sensing signal from beverage absence to beverage presence is counted (S364).

After completion of data storage (S342) and counting of storage time (S362 or S364), the user will close the open door, and thus the door switch 31 senses closing of the door (S370).

Next, the controller 200 judges whether or not a predetermined time has passed from closing of the door (S380), and turns off the light emitting device 21 upon judging that the predetermined time has passed (S390).

The predetermined time from closing of the door may be almost zero.

In the case of the method shown in FIG. 7, image capture by the camera 120 is implemented after closing of the door and therefore the predetermined time is required for image capture by the camera 120. However, in the method shown in FIG. 9, turning off the light emitting device 21 as soon as the door is closed may be advantageous in terms of reduction of power consumption.

Hereinafter, examples of a screen of the display or the mobile terminal will be described with reference to FIGS. 10 to 12.

Figure 10:
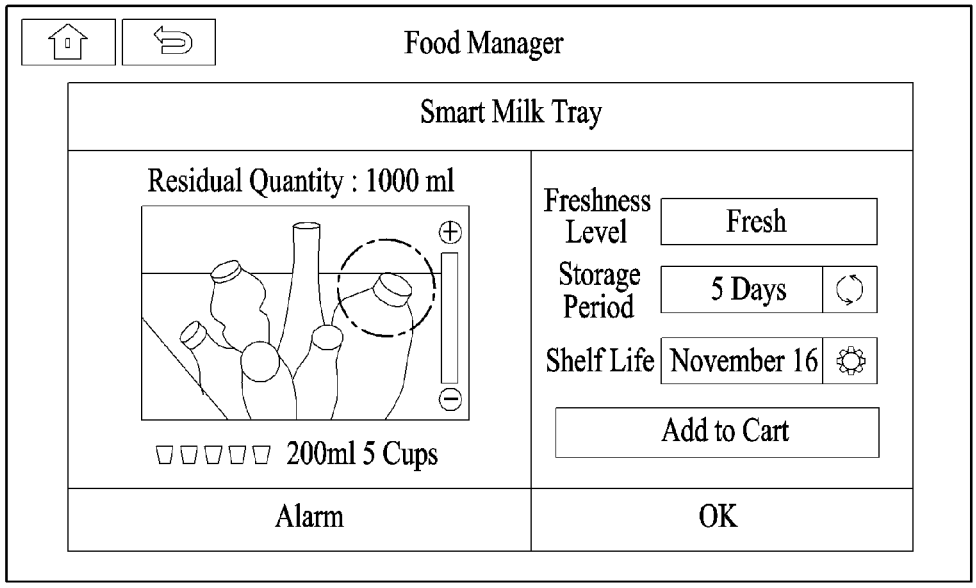
FIG. 10 is a front view showing an example of a screen of a display.

First, FIG. 10 shows an example display screen of the refrigerator. The left part of the display screen displays an image of the interior of the beverage receiving chamber 100 captured by the camera 120 and the residual quantity of a beverage, and the right part of the display screen displays freshness of the beverage and the storage period and shelf life of the beverage.

The user may perceive that the beverage within a circle designated by a dashed line is milk, and the image on the screen may be expanded or contracted.

For example, the residual quantity of milk is indicated as 1000 ml via text, and a symbol and text representing a cup may also be displayed.

An "Alarm" section displayed in the left bottom may be set to be activated (flickered) when the residual quantity of milk is, for example, 200 ml or less.

In this case, when the user touches the "Alarm" section, a pop-up window appears to display an alarm message on the screen.

The storage period of the beverage displayed on the left part, as described above, may be automatically counted and displayed, or may be input by the user upon initial reception of a specific beverage.

The shelf life of the beverage may be displayed when the user inputs the shelf life of the beverage. The "Alarm" section may be activated when the beverage is stored for a long period or when the beverage has a limited shelf life.

When a low quantity of milk remains, the user may add milk to a purchase list by touching a button "Add to Cart". As such, the user may purchase required items later with reference to the purchase list without omission.

As needed, the display 300 may be connected to an Internet shopping mall to enable online purchase through the display screen of the refrigerator.

Figure 11:
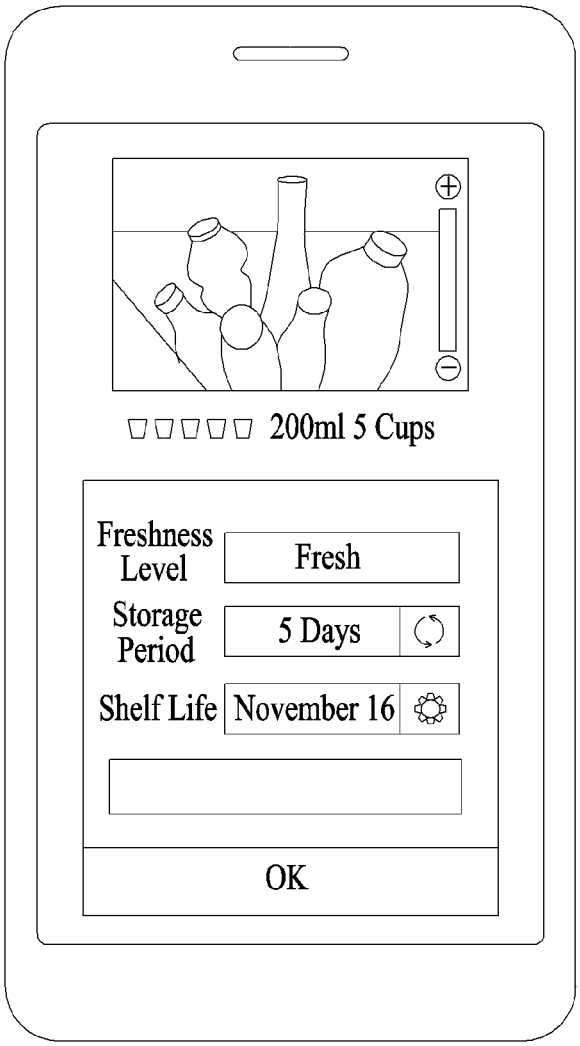
FIG. 11 is a front view showing an example of a screen of a smart-phone.
Figure 12:
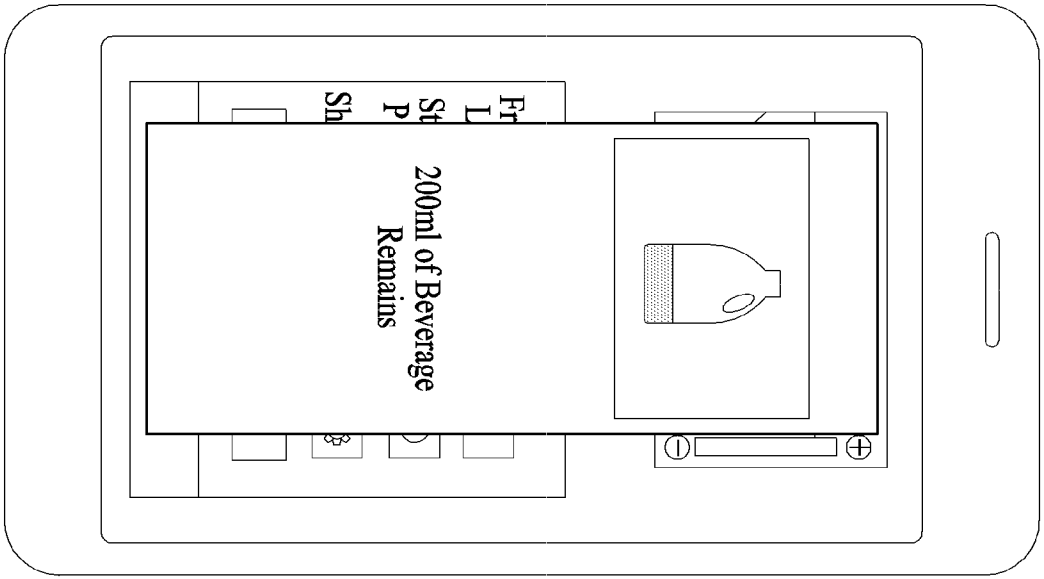
FIG. 12 is a front view showing an example alarm pop-up window displayed on the smart-phone of FIG. 11.

FIGS. 11 and 12 show an example screen of a smartphone as an example of a mobile terminal.

In FIG. 11, the upper part of a vertical screen of the smart-phone displays an image of the interior of the beverage receiving chamber 100 captured by the camera 120 and the residual quantity of a beverage, and the lower part of the vertical screen displays the freshness, storage period, and shelf life of the beverage.

The content displayed on the screen of the smartphone is identical to the above description of that in the display 300, and thus a repeated description thereof will be referenced, rather than repeated.

In the case of the smartphone, a refrigerator manufacturer may develop an application that may communicate with a controller of a refrigerator to display a control state of the refrigerator on the smartphone and to control the refrigerator via the smartphone, and distribute the application to users, and thus the users may use the application by installing the application on their smartphone.

FIG. 12 shows an alarm pop-up window displayed on the screen of the smartphone shown in FIG. 11.

When the screen of FIG. 11 displays that the residual quantity of milk is 200 ml, an alarm pop-up window as shown in FIG. 12 may overlap the screen of FIG. 11.

In addition, the image of the beverage or the aforementioned symbols or texts below the image displayed on the screen of FIG. 11 may be flickered to alert the user, and the alarm pop-up window as shown in FIG. 12 may not appear until the user touches the flickered portion.

As is apparent from the above description, through a refrigerator and a control method for the same, a user may attain beverage state information related to, e.g., the kind and residual quantity of a beverage received in a refrigerator without opening a door of the refrigerator, or even when the user is away from the refrigerator.

Further, it may be possible to automatically count the storage period of the beverage and to display the counted storage period along with the beverage state information related to, e.g., the kind and residual quantity of the beverage.

Furthermore, when the user inputs, e.g., the purchase date and shelf life of the beverage, it may be possible to additionally display this information. Owing to provision of this beverage state information, more fresh storage of the beverage may be accomplished.

It will be apparent that, although examples have been shown and described above, the disclosure is not limited to the above-described examples, and modifications and variations can be made by those skilled in the art without departing from the spirit and scope of the appended claims. Thus, the modifications and variations should not be understood independently of the technical sprit or prospect of the disclosure.

What is claimed is:

1. A refrigerator comprising:

a main body defining a storage compartment;

a door configured to open or close at least a portion of the storage compartment;

a beverage receiving chamber that defines a space for reception of a beverage container and that includes a sidewall part that extends upward from at least a portion of an edge of a base of the beverage receiving chamber;

a light emitting device;

a camera located in the beverage receiving chamber in its field of view and configured to capture an image of an interior of the beverage receiving chamber based on the light emitting device being in an on state;

a beverage residual quantity sensing device located at a bottom of the beverage receiving chamber and configured to measure a weight of the beverage container received on the beverage residual quantity sensing device, wherein the beverage residual quantity sensing device comprises:

a sensor case located in a recess defined in a bottom of the beverage receiving chamber and located within the sidewall part of the beverage receiving chamber;

a weight sensor located in the sensor case;

a support plate located on an upper surface of the sensor case and configured to support the beverage container; and a guide rib that extends upward from at least a portion of a rim of the support plate, that is located within the sidewall part of the beverage receiving chamber, that guides the beverage container to the beverage residual quantity sensing device, and that supports the beverage container from a lateral side of the beverage container;

a display configured to display the image of the interior of the beverage receiving chamber and a residual quantity of the beverage in the beverage container received on the beverage residual quantity sensing device; and a controller configured to control operation of the camera, receive a weight sensing signal from the beverage residual quantity sensing device, determine the residual quantity of the beverage received on the beverage residual quantity sensing device based on the weight sensing signal received from the beverage residual quantity sensing device, and provide a user with information related to both the image of an interior of the beverage receiving chamber and the residual quantity of the beverage on the beverage residual quantity sensing device via the display, wherein the camera faces the guide rib and is configured to capture an image of the beverage container.

2. The refrigerator according to claim 1, further comprising a door switch configured to sense whether the door is oriented in an open position or a closed position, wherein the controller is configured to:

delete stored information related to the beverage based on the door switch detecting the door in the open position, and based on the door switch detecting the door in the closed position:

maintain the light emitting device in an on state, control image capture of the beverage container by the camera in the on state of the light emitting device, receive a weight sensing signal of the beverage from the beverage residual quantity sensing device, and store the captured image and the weight sensing signal.

3. The refrigerator according to claim 1, wherein the beverage receiving chamber is defined by a receiving case including a bottom part on which the beverage container is placed, the sidewall part, and a cover part, and wherein at least the sidewall part is made of a transparent material.

4. The refrigerator according to claim 3, wherein the camera is mounted to a lateral side of a lower surface of the cover part and oriented to capture an image in a downward oblique direction.

5. The refrigerator according to claim 4, wherein the receiving case is mounted to an inner surface of the door.

6. The refrigerator according to claim 5, wherein the door comprises a main door that has an opening, and a sub door configured to open or close the opening of the main door, and wherein the receiving case is mounted to an inner surface of the main door and is open toward the opening of the main door such that an interior of the receiving case is accessible through the opening when the sub door is open.

7. The refrigerator according to claim 6, wherein the sidewall part has an opening opposite to the main door.

8. The refrigerator according to claim 4, wherein the cover part is a bottom part of another receiving shelf disposed above the beverage receiving chamber.

9. The refrigerator according to claim 1, wherein a rear portion of the guide rib has a height that is greater than that of a front portion of the guide rib from which the beverage container is retrieved.

10. The refrigerator according to claim 1, wherein the controller is configured to control display of the image of the interior of the beverage receiving chamber and the residual quantity of the beverage via the display or a mobile terminal of the user.

11. The refrigerator according to claim 10, wherein the controller is configured to display the image of the interior of the beverage receiving chamber using the image captured by the camera, calculate the residual quantity of the beverage based on the weight of the beverage container measured by the beverage residual quantity sensing device, and display the calculated residual quantity of the beverage.

12. The refrigerator according to claim 11, wherein the controller is configured to display a storage period of the beverage along with the image of the interior of the beverage receiving chamber and residual quantity of the beverage.

13. The refrigerator according to claim 12, wherein the controller is configured to alert the user via the display or the mobile terminal based on the controller detecting that the residual quantity of the beverage is a predetermined value or less or based on the controller detecting that the storage period of the beverage is a predetermined number of days or more.

14. The refrigerator according to claim 12, wherein the controller comprises:

an input device configured to receive beverage state information from the user;

a microcomputer configured to process information received from the input device and the beverage residual quantity sensing device;

a memory configured to store beverage state information; and a communication device configured to receive a user instruction signal and transmit the beverage state information via communication with the mobile terminal.

15. The refrigerator according to claim 14, wherein the controller is configured to calculate a remaining number of days of the beverage from the storage period of the beverage based on the beverage state information including a purchase date or shelf life of the beverage input via the input device by the user, and provide the user with freshness information and a remaining number of days of the beverage.

16. A control method for a refrigerator, the control method comprising:

receiving, by a controller located at a main body of the refrigerator, a request for beverage state information from a user;

based on receiving the request for beverage state information:

turning on a light emitting device in the refrigerator;

capturing an image of an interior of a beverage receiving chamber that defines a space that is configured to receive a beverage container using a camera in the beverage receiving chamber that is in a field of view of the camera; and measuring the weight of the beverage container located on a support plate on a weight sensor located at a bottom of the beverage receiving chamber that comprises:

a guide rib that extends upward from at least a portion of the support plate, that is located within a sidewall part of the beverage receiving chamber, that is configured to guide the beverage container to the support plate, and that supports the beverage container from a lateral side of the beverage container;

storing the captured image and measured weight data and turning off the light emitting device; and displaying both the captured image of the interior of the beverage receiving chamber and a residual quantity of a beverage in the beverage container simultaneously via a display of the refrigerator or a mobile terminal of the user.

17. The control method according to claim 16, further comprising alerting the user based on the residual quantity of the beverage being a predetermined value or less.

18. The control method according to claim 16, wherein storing the measured weight data comprises storing the measured weight data as volume data acquired by converting the residual quantity of the beverage calculated from the measured weight of the beverage container.

19. The control method according to claim 18, wherein displaying both the captured image of the interior of the beverage receiving chamber and the residual quantity of the beverage via the display of the refrigerator or the mobile terminal of the user is based on a user request for beverage state information.

20. The control method according to claim 18, further comprising displaying, on the display or the mobile terminal, a shelf life of the beverage input via an input device of a controller by the user.

21. The control method according to claim 20, further comprising alerting the user via the display or the mobile terminal based on detecting that the storage period is a predetermined number of days or more, or based on detecting that a remaining number of days of the beverage is a predetermined number of days or less.

* * * * *